US005417424A

United States Patent [19]

Snowden et al.

[11] Patent Number: 5,417,424

[45] Date of Patent: May 23, 1995

[54] PLAYER OPERATED WIN CHECKER APPENDED TO LOTTERY AGENT TERMINAL

[75] Inventors: Guy B. Snowden, Boca Raton, Fla.; Victor Markowicz, Englewood, N.J.

[73] Assignee: GTECH Corporation, West Greenwich, R.I.

[21] Appl. No.: 128,473

[22] Filed: Sep. 28, 1993

[51] Int. Cl.[6] ..... A63F 9/00

[52] U.S. Cl. ..... 273/138 A; 273/148 R; 273/139; 364/412

[58] Field of Search ..... 273/148 R, 138 A, 138 R, 273/139, 144 B, 269; 364/412

[56] References Cited

U.S. PATENT DOCUMENTS 3,505,646 10/1965 Affel, Jr. et al. .
4,033,588 7/1977 Watts .
4,072,930 2/1978 Lucero et al. .
4,101,129 7/1978 Cox .
4,108,361 8/1978 Krause .
4,254,404 3/1981 White .
4,322,612 3/1982 Lange .
4,323,770 4/1982 Dieulot et al. .
4,339,798 7/1982 Hedges et al. .
4,467,424 8/1984 Hedges et al. .
4,467,424 8/1984 Hedges et al. ..... 364/412
4,575,622 3/1986 Pellegrini ..... 273/138 A X
4,669,729 6/1987 Solitt et al. ..... 273/138 A
4,689,742 8/1987 Troy et al. .
4,768,151 8/1988 Birenbaum et al. .
4,772,025 9/1988 James et al. .
4,815,741 3/1989 Small .
4,833,307 5/1989 Gonzalez-Justiz .
4,842,278 6/1989 Markowicz ..... 273/138 A
4,875,164 10/1989 Monfort .
4,882,423 11/1989 Bergeron et al. ..... 273/138 A X
4,892,313 1/1990 James et al. .
4,996,705 2/1991 Entenmann et al. .
5,069,453 12/1991 Koza et al. .
5,265,874 11/1993 Dickinson et al. ..... 273/138 A
5,290,033 3/1994 Bittner et al. ..... 273/138 A

*Primary Examiner*—Vincent Millin
*Assistant Examiner*—Kerry Owens
*Attorney, Agent, or Firm*—Eckert Seamans Cherin & Mellott

[57] ABSTRACT

A wagering system such as a lottery with a central computer communicating with agent terminals at which tickets are issued, for example in convenience stores and the like, has a player-operated win-checking system coupled to the communications network, preferably as a peripheral to the agent terminal but possibly as a separate network terminal. Player choices and game identifications are bar coded on the tickets. A player scans the ticket automatically to trigger comparison of the bar coded data with winning entry data kept in a past game memory, such that the system need not resort to stored data on individual wager transactions to check for wins. This reduces the burden on the agent and the network because most issued tickets need not be checked by attempting to validate them for a payout. A limited number of past games are stored, e.g., the most recent thirty Keno game cycles of a game run at five minute intervals. One or more of the win checking system, the agent terminal and the central computer can hold the past game memory. Winning choice data is downloaded after each game, or scanned player choices are uploaded, to effect the comparison. If a ticket is too old for the corresponding game data to remain in the past game memory, the player is directed to the agent, who can use the terminal to attempt to validate the old ticket as a winner.

20 Claims, 4 Drawing Sheets

PLAYER OPERATED WIN CHECKER APPENDED TO LOTTERY AGENT TERMINAL

BACKGROUND OF THE INVENTION

1. Field of the Invention

The invention relates to the field of computerized wagering games with point of sale terminals coupled to a central computer in a network for managing the sale and redemption of wagers. A peripheral device is appended to a lottery agent point of sale terminal, for players to determine the win/lose status of a previously issued lottery entry form without unnecessarily burdening the computing or communication capacity of the lottery network, and without drawing upon the time available for use of the agent terminal to process wager sales and payouts. The invention is particularly applicable to automated games such as Keno, in which players choose a group of numbers to be matched against winning numbers in a drawing, and in which there are various alternative ways in which the chosen numbers and the drawn numbers may match (or not match) to produce a win.

2. Prior Art

Computerized wagering networks are used in connection with state-sponsored lotteries and with network-coupled terminals of gaming establishments such as casinos, race tracks and the like. Computerized networks are very effective for managing the sale of entries to players and the payout of winnings, while preventing fraud. One or more central computers is arranged for bidirectional data communications with each of a plurality of distributed terminals at which chances are sold to players by lottery agents. The agent terminals are typically placed in convenience stores, news stands, taverns and the like. The agent operating the terminal is often the same person who manages retail sales at the establishment, and the agent serves one customer at a time.

The agent terminal is a retail point of sale terminal with an on-board computer or processor that communicates with the central lottery computer, typically over a leased telephone line, dial-up modem or radio communication link. In addition to features of a point of sale terminal, such as an agent-interactive display, keyboard and typically a cash drawer, the agent terminal includes input/output devices particularly adapted for lottery ticket sales. An optical form reader coupled to the processor distinguishes the player's choices of numbers or the like on a hand-marked form. A printer reproduces the chosen numbers in one form or another on a ticket that is given to the player and later presented to the agent for redemption in the event of a win. A bar code, OCR or other scanner may be included, for reading coded data automatically from the printed ticket in systems that are equipped to print the data in that form.

It is also known to provide so-called stand-alone terminals that are much the same as agent terminals, but are operated by the player without the intervention of an agent. Although it is the player who feeds forms into a reader, deposits money and/or operates the keys on such a terminal, the functions are the same as in an agent terminal operated by the clerk of a convenience store or the like. The player's chosen numbers are indicated to the terminal via input devices, the processor in the terminal reports the transaction to the central computer, the central computer acknowledges sale of a wager, usually sending back a serial number or similar code, and a ticket is printed and issued to the player with the choices and the serial number or code shown thereon. The player-operated terminal serves one operator at a time, in the same way that the agent terminal serves one player at a time via operations conducted by the agent. For purposes of this disclosure, both player-operated terminals and agent-operated terminals are termed "agent terminals," because they provide the same functions and occupy the same position in the lottery agent network.

An important benefit of the computerized lottery network is the ability to protect against fraud due to alteration of the printed lottery ticket after a drawing is held and the winning number are chosen. This is accomplished by storing a record of the player choices for each wager sold, at all the agent terminals on the network. The data communications conducted when a ticket is issued typically include a report of the player choices to the central computer, where the choices are stored for future reference, and assignment of a serial number or other unique code to the wager. The stored choices are indexed to the unique code. If the ticket is later presented to claim a win, the ticket must be validated by communications with the central computer. According to the validation function of the agent terminal, the ticket presented as a potential winning ticket is read and the serial number or code and the player choices shown on the ticket are compared with the data stored centrally, to verify that the ticket is a winning entry. The reporting of data and the validation of winning tickets require a series of data transmissions and acknowledgements in both directions between the agent terminals and the central computer. Ticket validation operations occupy the agent terminal, the data communications system and the central computer. Although ticket validation is an important function, it detracts from the capacity of the network to manage the sale of wagers.

The agent terminal and the central computer may manage a variety of types of games concurrently, and the extent of such variations is limited only by the ingenuity of the system programmers. Variations may include different game types, different options regarding how many numbers (or other indicia) the player chooses to play a given game, how many chosen numbers must match the drawn numbers to win, how the numbers must match (e.g., in any order or in the same order), etc. The game can relate to a drawing to be conducted later, or in "instant" games the player entry is matched immediately against a random number generated by the agent terminal or by the central computer. These variations are also encoded in the data transmissions.

One variation that can be operated on a lottery agent terminal network is the traditional game of Keno. In this game, drawings are conducted repetitively on a periodic basis, and wagers applicable to the next drawing are collected from players during each period. As the game is operated in casinos, Keno runners collect the players' choices and money, enter the data at some central location, and return to the player a receipt or ticket showing the number entries. Similarly, after the drawing the runners interact with the players to determine, validate and pay on wins. This may also require the runner to make trips back and forth between the player and the central location at which the game is managed. Such an operation is advantageously automated. An automated Keno game has been developed by GTECH Corporation of West Greenwich, R.I., for operation over a lottery agent terminal network, and is presently in use in a number of jurisdictions.

Devices for automating one or more aspects of a more traditional form of the Keno game also are disclosed, for example, in U.S. Pat. Nos. 4,033,588—Watts and 4,254,404—White. Basically, such systems provide player operated terminals that communicate with a central computer, instead of having Keno runners travel back and forth between the players and the point of central management. Thus the automated Keno game is similar to player-operated agent terminals in a lottery system network.

Network coupled lottery terminal systems for various purposes are disclosed, for example, in the following U.S. Pat. Nos.:

3,505,646—Affel, Jr. et al.
4,108,361—Krause
4,323,770—Dieulot et al.
4,339,798—Hedges et al.
4,467,424—Hedges et al.
4,494,197—Troy et al.
4,689,742—Troy et al.
4,875,164—Monfort
4,996,705—Entenmann et al.
5,069,453—Koza et al.

In each case, the network coupled lottery systems involve agent terminals as discussed above. Self-service player-operated terminals functioning as agent terminals are disclosed, for example, in U.S. Pat. Nos. 4,322,612—Lange; 4,815,741—Small; and 4,833,307—Gonzalez-Justiz. The disclosures of these patents, and the foregoing Keno and network lottery systems patents, are hereby incorporated.

Lottery terminal networks with agent-operated terminals typically include a ticket validation function whereby a previously issued ticket that is presented to the lottery agent as a potential winning ticket is checked via data communications with the central computer to determine from the serial number and/or player-chosen numbers whether the ticket is a winner. The ticket validation function is applicable to self-service agent terminals; however, in a typical system the holder of a winning ticket must visit a terminal manned by an agent in order to claim a money prize.

Automated ticket validation is especially useful in the game of Keno. In this game, many numbers are involved which must be compared to the numbers drawn. Typically the players each choose up to ten or more numbers from eighty possible numbers, to be matched against twenty numbers chosen from the eighty in a drawing, for example by randomly drawing numbered bails from a drum, by a random number generator or by other means. There are many ways in which a given ticket can win. Prizes are paid for matching an improbably large proportion of the drawn numbers (e.g., more than five of ten), as well as for matching an improbably small proportion (e.g., none of ten). The amount of the payout on the win is based on the odds of the occurrence of the number of matches. For example, a larger number of matches (e.g., all ten) earns a larger payout than a smaller number (e.g., five). The problem of determining and quantifying a win is compounded by the fact that Keno games and the like may run very frequently (e.g., every five minutes). The ticket can apply only to a single cycle of the game, or to a plurality of games, for example in consecutive cycles.

A known Keno system for lottery agent terminal networks employs a display system wherein the agent terminal downloads to a video controller data on games that are in the process of being drawn. Players monitor the display(s) driven from the video controller immediately after purchasing a ticket, to determine whether they have won. However, many players do not monitor the displays, and miss the corresponding game data. A player cannot determine from the display of current game data whether he or she won in a previous game. The player is likely to be a customer of a convenience store, news stand, liquor store, bar or the like where the agent terminal is located. The player normally has other business to which to attend at the establishment, such as making product purchases.

It is difficult or impossible for the agent to display the winning numbers drawn for very frequent games for a sufficient period of time to permit all the winners to discover that they have won and to come forth. If the numbers are displayed, e.g., via the video controller mentioned above, it is still difficult for the players to find the numbers that apply to the correct game, and to compare the chosen numbers to those drawn to identify winning tickets dependably. In order to display the current game and the last several games, the display must be changed frequently, and the process detracts from the excitement of the current game.

On the other hand, the agent terminal and/or the central processor, being computers, readily can compare chosen numbers with drawn winning numbers for game cycles, process all the possible win combinations, and determine the payout, if any. Therefore, this aspect of Keno, and other games with many numbers or many winning combinations, is also advantageously automated. The coded ticket is presented by the player to the agent and read by the agent terminal. The agent terminal communicates with the central computer to validate the data, and either or both of the agent terminal and the central computer determine whether there is a win and calculate the amount of the win.

Automated win checkers are disclosed, for example, in U.S. Pat. No. 4,101,129—Cox; 4,892,313—James et al.; and 4,772,025—James et al., which relate to slot machine devices. In each case the player's assigned combination is examined automatically as to whether any of several winning combinations is present. In slot machines, the winning combinations are invariable (e.g., three or four of a kind in line, at four comers, etc.). With a Keno or similar agent terminal network, the winning combinations vary with every periodic Keno cycle. Thus, routinely it is necessary to use the agent terminal, or a player-operated stand alone terminal that is functionally equivalent to the agent terminal, to read or obtain information on the player's choices and on the numbers drawn in the corresponding cycle of the game, via communications with the central computer. Then the player's choices and the drawn numbers then can be compared for winning combinations.

However, this solution has its own problems. Agent terminals can become devoted to checking for wins (a non-revenue generating function), instead of processing ticket sales. The agent, who typically is the proprietor of the convenience store or other establishment and has other duties, spends a substantial proportion of his or her time attempting to validate tickets as winners, so that players can determine whether they have won.

Whether accomplished on an agent terminal operated by the agent or by the player, validation checks require a sequence of communications over the lottery network with the central processor, and a substantial portion of the communication capacity and computing capacity of the network is consumed.

SUMMARY OF THE INVENTION

It is an object of the invention to employ a computerized agent terminal lottery system network for checking wins, especially in games such as Keno that have numerous potential win combinations and/or very frequent game cycles, without burdening the communications and computing power of the system or detracting from the functions of processing wager sales and payouts.

It is also an object of the invention to enable lottery games to proceed on a very frequent cycle, while retaining the ability of players to conveniently and quickly determine whether they have won.

It is a further object of the invention to minimize the need to display the results of previous lottery games to enable players to check for wins.

It is yet another object of the invention to determine wins very accurately, such that winning combinations held by a player are not inadvertently overlooked.

These and other objects are accomplished by a computerized wagering system especially for lottery systems with a central computer communicating with agent terminals in convenience stores and the like. A win-checking system is coupled to the communications network, preferably as a peripheral of an agent terminal, for handling win checking function by enabling comparison of player ticket data with the winning numbers and corresponding game identification for each of a series of wagering games. The win checking system can be arranged as a receive-only terminal on the network, but preferably is coupled as a peripheral device to an agent terminal through which the winning choice and game identification data are passed. Winning data and game identifications are stored in a memory that holds data for a most recent set of wagering games, for example the last thirty games in a repetitive Keno game operating as often as every five minutes. The win checking system reads tickets presented by players, e.g., via a machine readable code on the tickets. The player choices are compared to the stored data representing the most recent games. As a result, it is not necessary to undertake full scale attempts to validate a ticket, in order to determine that the ticket is a winner. Communications and computing steps are substantially reduced, freeing the agent terminals for the processing of ticket sales and redemptions.

The win checking comparison can relate to the number of matching choices, an exact correspondence or the like, and in Keno a ticket may even win because the player failed to match any number, which is improbable. The amount of a win can be calculated, or alternatively the existence of a winning combination can simply be determined and indicated. The win checking system does not require use of the terminal functions, the attention of the agent or the use of the communications network for win checking, because the ticket data is simply checked against the stored recent win data, automatically and at the request of the player. The player simply places the ticket on the read window of an automatic reader on the win checker. A ticket identified as a winner (due to meeting some criteria of correspondence between choices and winning numbers) can be validated later at the agent terminal, e.g., to collect on a win following a preliminary win indication by the win checker. Similarly, a ticket that is too old to remain in the recent game memory can be indicated to be too old for checking via the win checker, whereupon the agent terminal must be used to attempt to validate the ticket as a winner and thereby determine whether it is a winner. The win checker is player-operated, and the automatic reader can include a bar code reader or other optical or electromagnetic device for discerning the game identification and player choices on the ticket. Preferably, the win checker includes a scanner operable to read a player ticket when simply placed against a scan window. The output of the win checker can include an indicator or message device that is activated to show the ticket's win/lose status or to report that the corresponding game data is no longer in memory. The indicator or message device can be arranged to instruct the holder of a winning ticket, or the holder of a ticket that cannot be checked, to visit the agent.

The invention facilitates games such as Keno that have numerous potential win combinations and can be run very frequently. However, the win checking function cannot burden the communications and computing power of the system or detract from the functions of processing wager sales and payouts. Players can conveniently and quickly determine whether they have won, and need not refer to, nor must the agent maintain, an extensive display of the results of previous games. Winning combinations held by a player are found automatically and cannot inadvertently be overlooked, leading to additional player confidence in the game.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
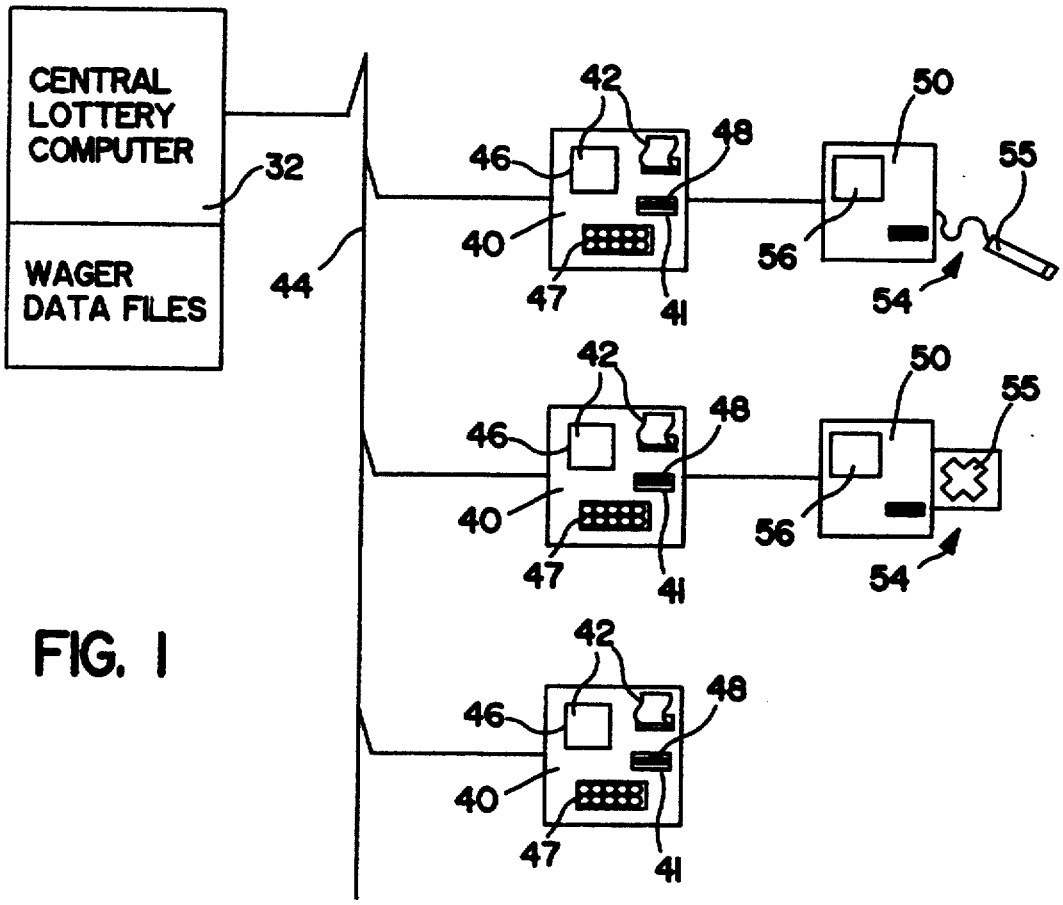
FIG. 1 is a block diagram showing a computerized wagering system according to the invention.

FIG. 1 shows a computerized wagering system according to the invention, wherein player choices are matched with winning indicia in playing a wagering game such as Keno. The system includes one or more central computers 32 that manage successive wagering games by communications with a plurality of distributed wager processing terminals 40 at which the wagers are sold to players and at which the players present winning tickets for validation.

The wager processing terminals or agent terminals 40 can be attended or unattended (i.e., player-operated). The agent terminals 40 are in at least intermittent data communication with the central computer 32 for accepting and paying on wagers in the wagering games. Such communications can be by telephone leased line, dial-up modem, radio communications, etc. The communications require that the respective wager processing terminals 40 share the available communication capacity of the network, and share the computing capacity of the central computer 32.

The agent terminals 40 each have input means 41 and output means 42 for managing a player entry, and are operable interactively with an agent or a player to accept wagering data, from one customer or player at a time. The wagering data defines choices of players of the wagering games managed by the central computer 32, which choices are to be compared against winning choices to be drawn at the conclusion of the game. The game can be any lottery or the like in which player choices are matched to randomly drawn or otherwise determined choices. However, the invention is particularly useful in a lottery game such as Keno, which is operated repetitively, and in which there are a variety of ways to win. In a Keno game cycle, the players typically choose up to ten or more numbers from eighty possible numbers, and at the conclusion of the cycle, entries are closed and twenty numbers are drawn. Whether a player wins is determined by the extent to which the player's choices match the numbers drawn. For example, five or more matches may be needed to win. Additionally, the game may award a prize for an improbably low number of matches (e.g., zero) in view of the number of selections made. The system is also applicable to other types of games, for example wherein a win may require an exact match of digits in order ("regular"), or may only require the appearance of the chosen digits in any order ("boxed"). According to the invention, the winning numbers for a plurality of past game cycles are stored in a memory and indexed to an identification of the corresponding game cycle. When player ticket data is scanned or otherwise read into the win checker, this past game data is accessed. The player choices are compared to the winning choices for the corresponding game, i.e., any of a number of past games that are stored. Preferably, the ticket data is checked for a win according to all possible combinations. This function is accomplished apart from the normal functions of the agent terminal 40, and thus does not interfere with or burden the agent terminal operation. Moreover, the agent operating an attended terminal need only spend time on wager sales and validation of tickets already found to be winners by the win checker. The agent's time is therefore available for regular duties in the operation of the establishment.

The agent terminals 40 include interactive input and output means 41, 42 for present rag options to the operator and obtaining the operator's responses, in order to process each wager. When the wager is sold to the player, the agent terminal 40 reports the applicable wagering data to the central computer 32 over the communications network 44, and receives an acknowledgment code from the central computer 32, referenced to the player entry, indicating that the wager has been accepted and the pertinent data has been stored and indexed to the acknowledgment code. The agent terminal 40 includes at least a display 46 and a keyboard 47 for interaction with the operator, and preferably also includes an optical reader 48 that can distinguish data marked on hand-marked forms by which the players indicate their choices, and/or data presented on issued tickets when returned for redemption.

When an entry is reported to the central computer 32 and the data is stored in the memory of the central computer, the acknowledgement or reference code assigned to the transaction and reported by the central computer 32 to the agent terminal 40, permits the specifics of the wager to be checked later, to verify that a ticket presented as a winning ticket is indeed a winner. The agent terminal 40 is operable to print a ticket bearing the player choices and the reference code for this purpose, and the ticket is issued to the player as evidence of the wager.

When the results of a given game are announced, the player can compare his or her choices with the winning numbers or other indicia resulting from the drawing or other event by which winners are chosen. A player holding a winning ticket presents it at the agent terminal 40 to claim a prize. To validate the winning entry, the printed ticket is read at the agent terminal 40 and the ticket data is checked against the previously stored data to verify that the ticket is a winner. The optical reader 48 of the agent terminal 40 is used to read the ticket, or a bar code scanner or similar reader can be provided, assuming the data is presented in the required form. This function of validating tickets uses the input/output devices 41, 42 of the agent terminal 40 as well as the communication and computing capacity of the network 44 and the central computer 32. These are needed to initiate the validation function, to communicate the data needed to identify the specific wager, to check the stored data on that wager against the winning numbers for the corresponding game, and to report the results to the operator.

According to the invention, a win-checking system 50 is coupled to the network, preferably via one or more of the wager processing terminals 40, and is arranged to facilitate ticket checking without accessing the data on the specific wager, e.g., off-line. The winning selections for each successive game and the identification of the respective game are stored in a memory, and the selections on a ticket are checked against the winning selections for the corresponding game to determine the win status of the ticket. Whereas all the input/output, computing and communications steps needed to validate a wager are not needed, substantially less of a load is placed on the agent and on the network.

For example, after each game cycle, the winning selections can be reported from the central computer 32 to the distributed terminals on the network agent terminal 40. The agent terminal 40 can store the winning selections in memory or download the winning selection data for the game for storage in a memory of the win checking system 50. Alternatively, the past game data memory can be disposed in the agent terminal, or the data may even remain in the central computer memory, for access according to the win checking function. Communications are minimized where the data is downloaded once to a memory in the win checker. However, regardless of whether the past game data is stored in the win checker, the agent terminal or the central computer, the load on the network is reduced by providing the capability to check wins from a win checking terminal apart from the agent terminal, thereby releasing the agent from this duty. Only those tickets shown by the win checker 50 to be winners need to be presented at the agent terminal 40 for validation. The ticket data stored by the central computer upon issue of a wager need not be searched or otherwise accessed to effect the win checking function, and is searched only for validations or to handle tickets for games whose data is no longer stored in the past game memory.

Figure 2:
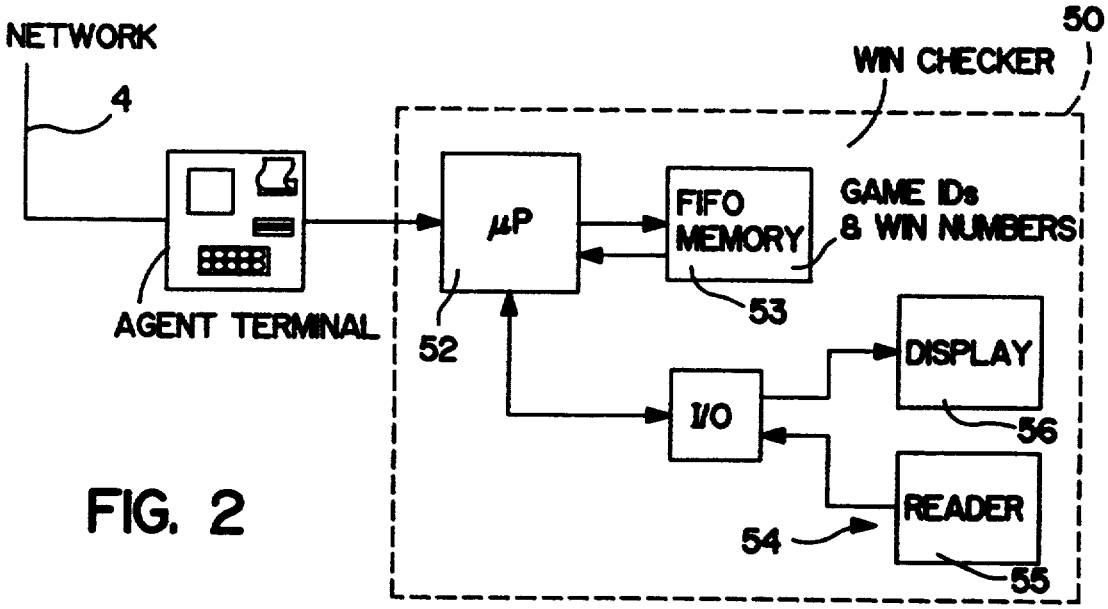
FIG. 2 is a block diagram showing a win checking system according to the invention, coupled to one of the wager processing terminals or agent terminals.

An embodiment of the ticket checker 50 of the invention is shown in FIG. 2. The ticket checker includes a processor 52 with a data memory 53, coupled to the agent terminal 40 for receiving data from the terminal 40 (that in turn receives this data from the central computer 32). The winning data for a game cycle in this case can be broadcast one time over the network to be stored in the win checker and/or in the agent terminal in a manner available for checking against data on tickets presented to the win checker. Alternatively, the agent terminal 40 can be arranged to request a report of winning choices from the central computer for an identified game, or can transmit simply the player choice numbers and game identification reported by the win checker to the agent terminal, with a request for win checking short of validation. In any case, the agent is not called upon to manage a validation, and the central computer need not access data on a particular validated wager. The game identification and the player choices are all that is required, for checking against the stored winning selections in the past game data memory.

The game identification and winning choices for each successive game are stored for random access in the past game data memory, preferably a rotating FIFO memory having the capacity to store the results of a plurality of the successive games. To accommodate current customers, a storage capacity that exceeds the likely duration of a player's visit to the establishment is adequate. It is also possible to store an amount of data that corresponds to the likely frequency of player visits to the establishment. By storing a day of data, for example, players who return about the same time every day can check for wins in the previous day's wagers, etc.

The win checker 50 includes input means 54 coupled to its processor 52, for entering from the issued ticket the player choices and the identification thereon. Preferably, the ticket is printed with an optical code such as a bar code, including a representation of the player's choices and the game identification. An OCR code, magnetic code or the like can also be used, or the data can be read from an integrated circuit card or similar memory device belonging to the player. For this purpose, the win checker 50 includes an appropriate reader 55 for discerning the data on the printed ticket. According to a preferred embodiment, the win checker includes a bar code scanner having a window against which the user places a ticket on which the bar code data identifies both the game and the player's choices. The past game memory is accessed, and the winning selections are located with reference to the game identifications, and compared with the player choices.

Figure 3:
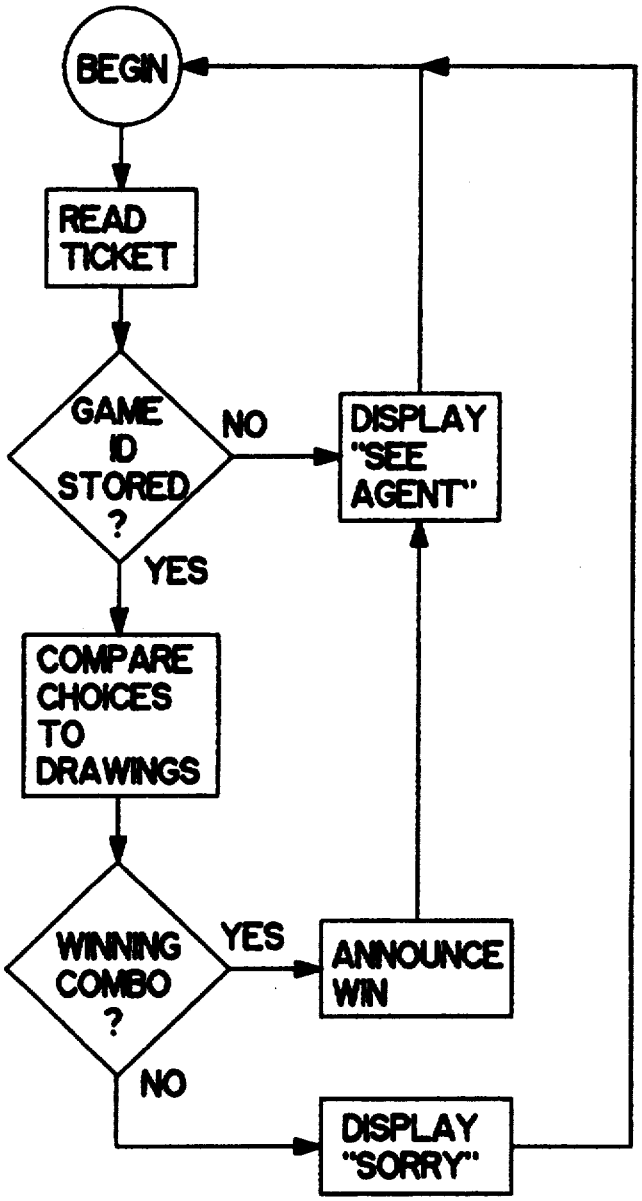
FIG. 3 is a flow chart showing the functions of the win checking system.

An exemplary operation of the win checker 50 is shown by the flow chart in FIG. 3. The processor 52 of the win checker 50 is operable to compare the identification and the player choices from the ticket with the winning indicia and the identifications of the successive games stored in the past game memory. The actual comparison of numbers, and potentially the computation of the amount of the win, can be a function of the processor 52 of the win checker, the processor of the agent terminal, or if the past game memory is stored centrally, the central processor can make the actual comparison. The processor effecting the comparison preferably is programmed to test for each possible winning combination, depending on the type of game. The type of game can be discerned from the game identification, or otherwise can be provided on the ticket (e.g., tickets having predetermined dimensions, color or the like can be sensed by the win checker input means 54, to partly identify the game together with a code identifying the game cycle). In the event that a ticket whose selections and game identification are discerned in this manner contains a winning combination, the display or other output means of the win checker is operated under control of the processor 52, or is triggered from an output of the agent terminal processor or central processor to so advise the player.

Unlike the procedures undertaken to validate a winning ticket, which requires accessing the memory of the central computer 32 to reference the record on a particular wager, the win checker of the invention relies on the presence of the winning combination on the ticket, and the storage of the winning combinations for a plurality of past games. It is not necessary to reference data stored centrally at this stage of the proceedings. The past game memory is preferably disposed in the win checker or agent terminal, in which case no network communications or input/output are needed except for the original reception of winning number data to be stored. If the past game memory is provided in the win checker, the win checking function can also proceed without communications between the win checker and the agent terminal, except for reception of the winning numbers by the win checker. It is possible to include the past game data memory in the memory of the central processor, and still to save processing time because the individual wager data need not be accessed. Similarly, the processor in the agent terminal can be used to effect the comparison of numbers, etc., and normally such use of the agent terminal processor does not unduly slow its operation with respect to processing the sale of wagers. In any event, player tickets can be checked quickly and conveniently for winners and the results indicated to the players, without requiring the attention of the agent, without accessing the stored data on individual wagers, and preferably without communications for the ticket through or using the terminal 40 and the central computer 32. The win checker 50 relies on the report of winning numbers downloaded from the network 44 or otherwise entered into the past game data memory.

The win checker is provided on at least one agent terminal on the network, and the network can be operable where some agent terminals or agent terminal premises have win checkers while others do not. Preferably, any communications with the win checker (e.g., downloading of game data and identifications) occurs through the agent terminal 40, to which the win checker 50 is appended as a peripheral device. Alternatively, the win checker can operate as a terminal on the network, operable to receive data over the network directly from the central processor. By providing one or more win checkers coupled to the agent terminal as a peripheral, the win checker has the benefit of the modem or other communication means already provided in the agent terminal for network communications.

Assuming the win checker is coupled in data communications with the network through the agent terminal (i.e., as a peripheral device), the communications between the agent terminal and the win checker can be accomplished in various ways. Data can be passed between the agent terminal and one or more associated win checkers over a hard wired, multiplexed, optical (e.g., infrared or fiber optic), radio or other signalling channel.

While the win checker is operating, the agent is free to process validation of winning entries and to manage payouts. The agent terminal 40 is used as a point of sale terminal to sell wagers, and alternatively for data communications with the central computer 32 for win validations. Communications and operator attention needed for validation are substantially reduced, being limited to processing tickets which have already been determined to be winning tickets, by operation of the ticket checker 50, or tickets on game data that is too old to remain in the past game memory.

The past game memory comprises a first-in first-out data table storing the game identifications and corresponding winning numbers. Whereas the amount of memory is limited, it is possible for a player holding an old ticket to attempt a win check after the data for the corresponding game has been deleted (e.g., overwritten). In a case where the game identification is not found in the past game memory, the display means or other output device 56 of the win checker 50 is operated to direct the player to visit the agent terminal, where the agent can attempt to validate the ticket as a winning ticket, in a conventional manner.

Figure 4:
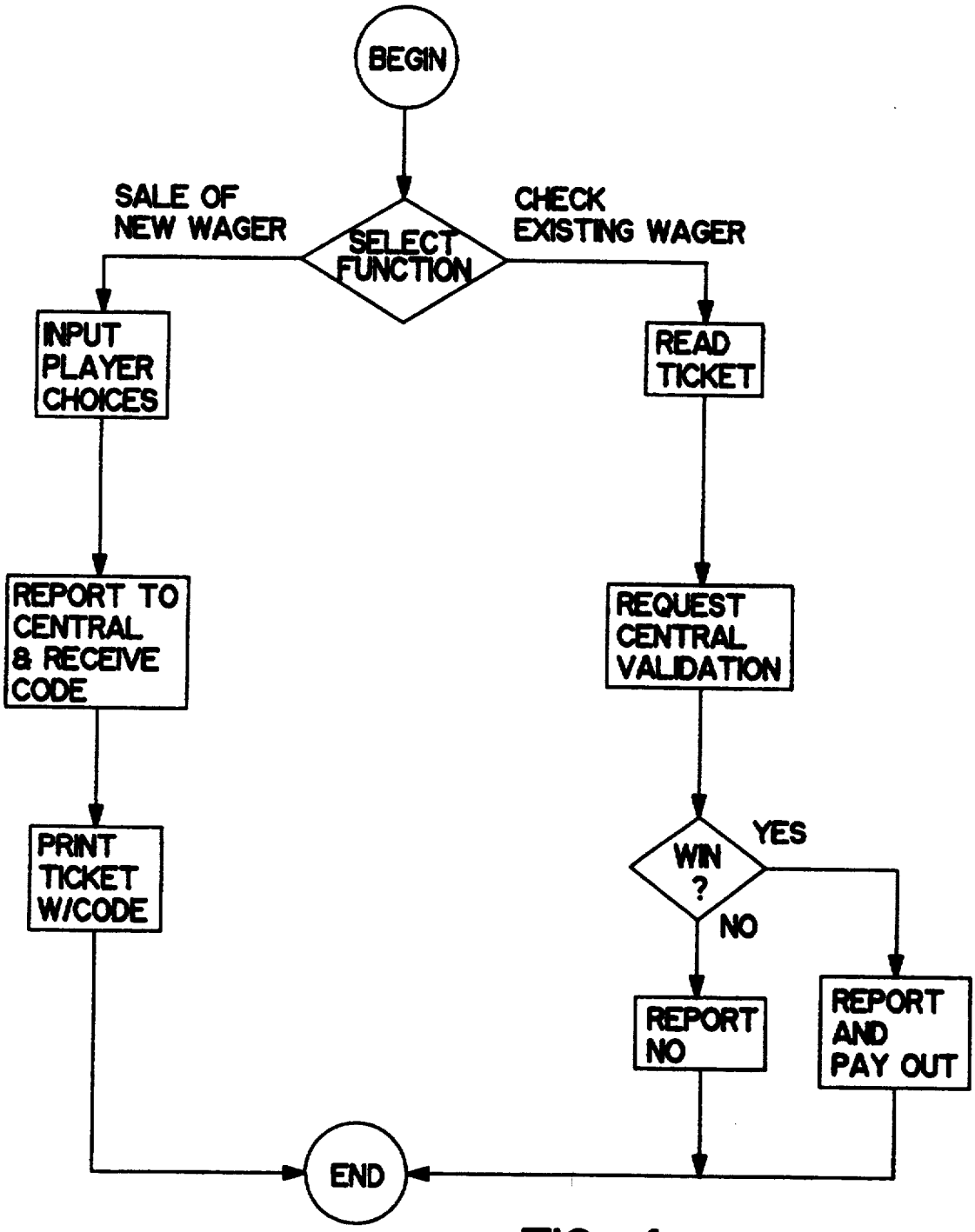
FIG. 4 is a flow chart showing the functions of the wager processing terminal.

The agent terminal 40 is operable in a conventional manner to choose between, and to effect, both the sale of wagers and the validation of tickets presented as winners. The win checking function does not require any attention of the agent. The communications needed to support the win checker are minimal and within the capacity of a simple agent terminal processor without noticeable delay in other functions. Operation of the agent terminal 40 is shown in FIG. 4. Validation of winning tickets, and win checking by attempting to validate a ticket, is accomplished by entering from the ticket the player choices and the identification thereon, on the agent terminal input means 41, after choosing the ticket validation option presented on the agent terminal display 46. The agent terminal 40 transmits at least one of the player choices and the identification, and/or a code referenced to the player entry by the acknowledgment received from the central computer 32 when the ticket was reported and issued. At least one of the terminal 40 and the central computer 32 are operable to compare the identification and the player choices from the ticket with the winning indicia and the identifications of the successive games stored in the central computer 32, and to distinguish a winning combination therein. The memory of the central computer 32 is large enough to store more game data and for a much longer period than the past game memory, at least including the period of time during which the ticket can be cashed in, usually one year. Moreover, the central computer memory includes the much more extensive storage of data referenced to individual wager transactions (at least including the serial number and the selections on each wager that may later be presented as a winning ticket). The output means of the agent terminal 40 is operated when attempting validation to indicate whether or not the ticket as issued held a winning combination. In this manner the screening of tickets can be accomplished via the win-checking system 50 and validation of winning tickets can be accomplished using the terminal 40. However, because the win checker 50 is used for determining the win/lose status of most of the tickets, and the agent terminal 40 is not needed to service tickets other than winners or those presented long after the game is held, the system minimizes data communications and processing requirements of the agent terminals 40 and the central computer 32.

The input means coupled to the processor 52 of the win-checking system 50 preferably comprises an automatic ticket reader 55 for discerning the player choices and game identification. The ticket reader 55 can be of various types, complementing the ticket printer of the agent terminal 40. An appropriate automatic ticket reader may comprise one or more of an optical character reader for bar code, OCR characters or the like, a magnetic strip reader, a data communications receiver, etc. A bar code reader is preferred, and the reader can be associated with a window in the casing of the win checker 50, on which the player places the ticket for reading in a manner similar to a supermarket UPC code scanner. The bar code encodes the game identification and the player choices. For win checking via the win checking system 50, it is not necessary to read the serial number or similar authorization code. However, this number can be included in the code for use when validation is attempted via the agent terminal 40.

The computerized wagering system according to the invention is particularly useful where the successive wagering games involve matching a first number of player choices to a larger number of potential winning choices, a winning entry being determined by at least one of correspondence, and extent of the correspondence, between the player choices and winning choices that are chosen from the potential winning choices for each of the wagering games. The processor 52 of the win-checking system 50 includes means for determining whether the player choices from the ticket exceed a minimum correspondence meriting a payout. As used for Keno, the processor 52 of the win-checking system 50 preferably also includes means for determining that the player choices from the ticket fail to exceed a second, lower minimum correspondence meriting a payout. The wagering games are conducted periodically, many times per flay, for example at five minute intervals, with wagers preferably being collected from numerous agent terminals distributed over a wide area. The memory 53 of the win checker processor 52 includes capacity to store at least a most recent hour of winning combinations and identifications, which is sufficient time for current customers of most types of establishments to visit the win checking device after a game is completed. Preferably, in a five minute cycle system, about thirty previous games are stored, which amounts to two and a half hours of games. Of course, the past game memory can also encompass a longer time, e.g. , days or weeks, to accommodate customers who visit an establishment on a regular basis.

The win checking device 50 is preferably coupled to the agent terminal 40 as a peripheral device. The agent terminal 40 thus receives the winning number and game identification over the network 44 from the central computer 32. This communication can be a packet of data preceded by a header identifying the following data as a report of winning numbers and a game identification. The win checker processor 52 can be coupled to the agent terminal internal bus (not shown), and can be addressed for accepting data from the agent terminal processor. The output of the win checker 50 is preferably limited to a display to the customer, in which event the communications between the agent terminal 40 and the win checker 50 can be one-way, i.e., from the agent terminal 40 to the win checker 50. Alternatively, such communications can be two way, for example with the win checker sending the game identification and choice data to the agent terminal processor and the agent terminal processor accessing the past game data (either locally or via a communication with the central computer, limited to the game identification and choices). The agent terminal in that case reports to the win checker the outcome of the comparison, or activates an output means in the win checker by an appropriate signal.

Various bells and whistles may be triggered in the event a winning ticket is found. It would also be possible for the win checker 50 to pass additional data back to the agent terminal 40 regarding tickets that have been read, such as the serial number on the ticket, so as to avoid duplication of this function for validation.

Figure 5:
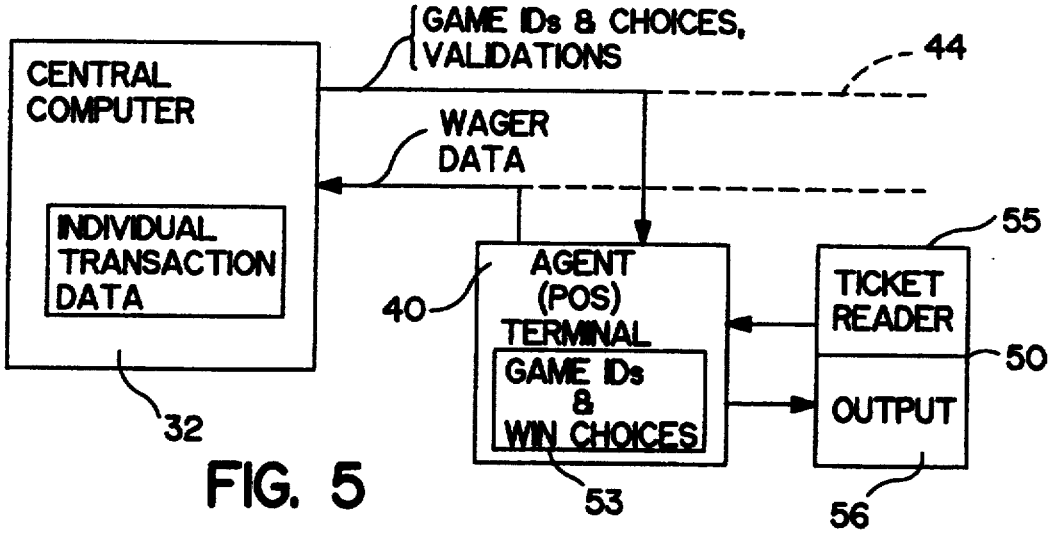
FIG. 5 illustrates an alternative embodiment in which the past game data memory is disposed in the agent terminal.
Figure 6:
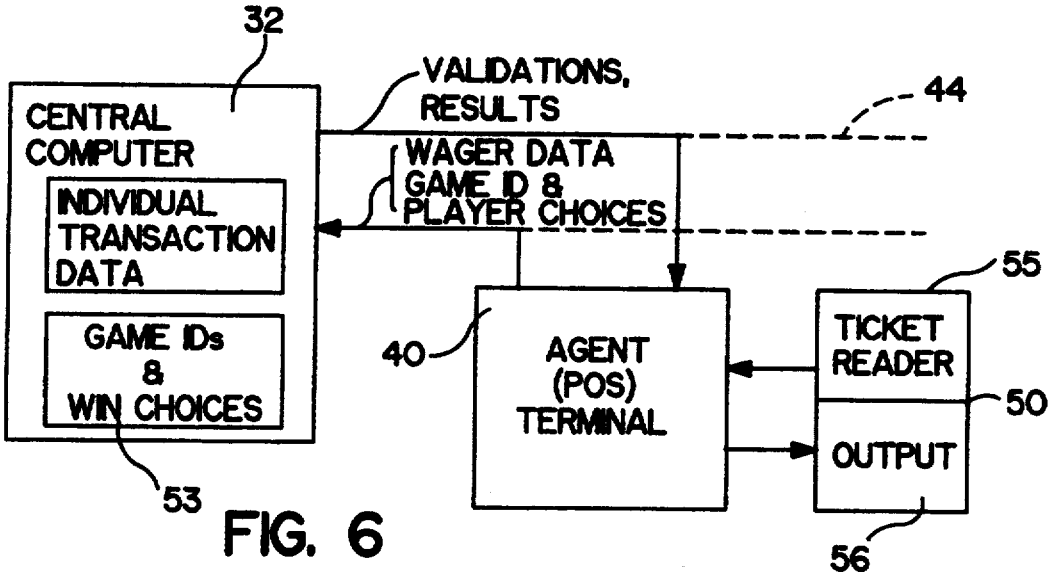
FIG. 6 illustrates a further alternative in which the past game data is disposed in the central computer.

In FIG. 2, the past game data memory 53 is disposed in the win checker. FIG. 5 illustrates an alternative embodiment in which the past game data memory is disposed in the agent terminal. According to this arrangement, the win checker reports the player choices and game identification to the processor of the agent terminal, and the processor of the agent terminal determines whether the player choices and the past game data meet at least one winning criteria. An output from the agent terminal triggers the output means of the win checker. The particular location of the past game data memory can be varied, and need not be in the win checker as in FIG. 2. Whereas checking the player choices against the winning choices is a quick and easy function (as compared to accessing the data originally stored centrally on the particular transaction), the past game memory can be kept in the agent terminal as in FIG. 5 for access by the agent terminal processor, or centrally as in FIG. 6 for access by the central computer. Either the winning choices and game identifications are downloaded to the agent terminal (FIG. 5) and/or to the win checker (FIG. 2), or the player choices scanned from the issued ticket are uploaded (FIG. 6).

Figure 7:
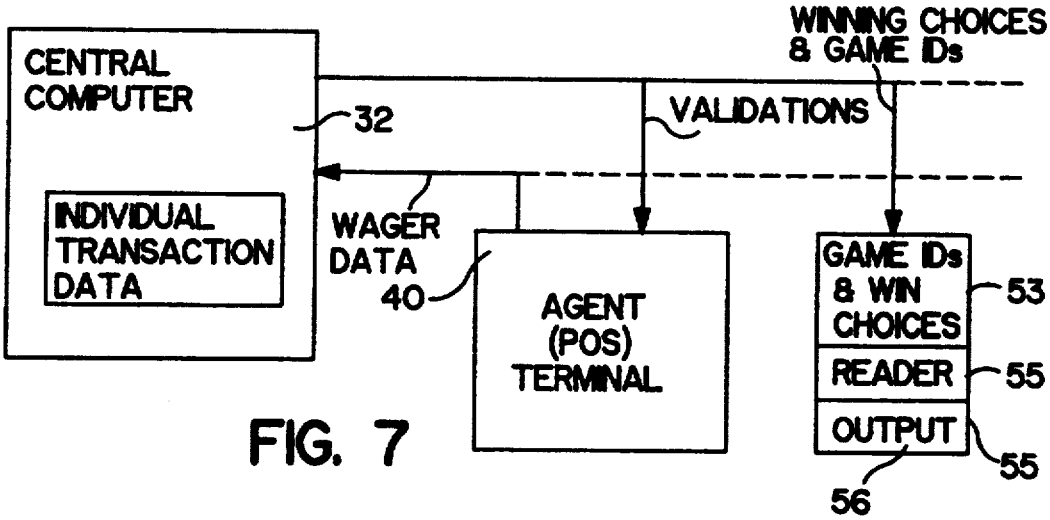
FIG. 7 is a block diagram showing a win checker according to the invention coupled as a terminal on the lottery network.

If the past game data is stored for access by a processor in the win checker, the hardware is somewhat more expensive, but data transmissions are limited to downloading of the winning choice and game identification data. According to this alternative, the win checker can be a separate terminal on the lottery network as in FIG. 7. The win checker need only monitor the network for a report of game results, and store the results at the next position in the past game memory. If the past game data is stored in the agent terminal, communications between the agent terminal and the win checker are needed to report either the scanned data or the winning game data. However, the win checker need not include its own communication means for interfacing with the network.

Thus, the win checker 50 can be arranged as a terminal on the network 44 (i.e., in a position similar to that of the agent terminal) rather than a peripheral to the agent terminal. In that case, the win checker 50 can monitor communications on the network 44 for a code indicating that the following information represents the report of winning numbers for an identified game. The win checker 50 then downloads the information and increments its memory address registers to advance to the next memory location for storage of game data. Alternatively, as discussed above, the win checker can communicate with the central computer and report the results of a comparison made by the central computer between the ticket data and the past game data stored centrally.

The win checking system according to the invention minimizes the burden on the communications and computing power of the lottery system as a whole, and substantially relieves the agent terminal operator of the duty to check for winning tickets by attempting win validations. Supporting one or more win checkers associated with an establishment requires as little as a general broadcast report of the results of games as they occur, for storage by the win checker or by the agent terminal. This data requires only a brief transmission. Players can conveniently, quickly and accurately determine whether they have won. Players need not refer to, nor must the agent maintain, an extensive display the results of previous games. Winning combinations held by a player cannot inadvertently be overlooked, leading to additional player confidence in the game.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A computerized wagering system wherein player choices are matched with wiring indicia, comprising:

at least one central computer operable to manage successive wagering games;

a plurality of distributed wager processing terminals in at least intermittent data communication with the central computer, the wager processing terminals and the central computer accepting and paying on wagers in the wagering games, each said terminal having input means and output means for managing a player entry via interactive display and input between the terminal and one or both of an agent and a player operating said terminal, the terminal and the central computer accepting wagering data defining choices of players of the wagering games managed by the central computer, said wagering data being reposed to the central computer, acknowledged to the terminal by the central computer as referenced to the player entry, and evidenced by a ticket for the player entry, the ticket bearing the player choices and an identification of the game, at least part of said wagering data being recorded for later reference, whereby the ticket can be verified to be a winning ticket when presented for redemption as a winning ticket;

a player operated win-checking system separate from the wager processing terminals, the win-checking system being coupled to the computerized wagering system, the win-checking system comprising input means for entry of player choices and a corresponding identification of the game from an issued ticket;

a past game memory coupled to at least one of the central computer, one of the wager processing terminals and the win-checking system, for receiving and storing said winning indicia after the winning indicia is determined for the successive wagering games, the winning indicia being indexed to the identification of the game, wherein at least one of the win-checking system, the central computer and said one of the wager processing terminals is operable responsive to the win-checking system to make a comparison of the player choices from the issued ticket of a particular player entry, with contents of the past game memory applicable to a corresponding game, and to distinguish a winning combination therein; and, output means coupled to the win-checking system for indicating whether or not the winning combination is found on the issued ticket, responsive to a result of said comparison, whereby the winning combination is found and indicated unofficially by the win-checking system, apart from said operation of the wager processing terminal for validating winning tickets, and without reference to the particular player entry in the wagering data as needed to validate the ticket as a winning ticket.

2. The computerized wagering system according to claim 1, wherein the wager processing terminal is also alternatively operable interactively for data communications with the central computer for entering from the ticket the player choices and the identification thereon and communicating at least one of the player choices and the identification, and a code referenced to the player entry by the acknowledgment, at least one of the wager processing terminal and the central computer being operable to compare the identification and the player choices from the ticket with the winning indicia and the identifications of the successive games stored in the central computer, and to distinguish a winning combination therein with reference to the particular player entry in the wagering data; and, wherein the output means of the wager processing terminal is operable for indicating whether or not the winning combination was found on the ticket;

whereby screening of tickets is accomplished via the win-checking system and validation of winning tickets is accomplished using the wager processing terminal.

3. The computerized wagering system according to claim 1, wherein the input means coupled to the processor of the win-checking system comprises an automatic ticket reader.

4. The computerized wagering system according to claim 3, wherein the automatic ticket reader comprises at least one of an optical character reader, a bar code scanner, a magnetic strip reader, and a data communications receiver.

5. The computerized wagering system according to claim 1, wherein the successive wagering games involve matching a first number of player choices to a larger number of potential winning choices, a winning entry being determined by at least one of correspondence, and extent of the correspondence, between the player choices and winning choices that are chosen from the potential winning choices for each of the wagering games, and wherein the processor of the win-checking system includes means for determining whether the player choices from the ticket exceed a minimum correspondence meriting a payout.

6. The computerized wagering system according to claim 5, wherein the wagering games include Keno and the processor of the win-checking system also includes means for determining that the player choices from the ticket fail to exceed a second, lower minimum correspondence meriting a payout.

7. The computerized wagering system according to claim 6, wherein the wagering games are conducted periodically a plurality of times per day, and wherein the memory of the processor includes capacity to store at least a most recent hour of winning combinations and identifications.

8. The computerized wagering system according to claim 7, wherein the wagering games are conducted at about five minute intervals and the memory of the processor includes capacity to store about thirty winning combinations and identifications.

9. The computerized wagering system according to claim 1, wherein the win-checking system is coupled to the computerized wagering system through the terminal, and wherein the winning indicia is transmitted from the central computer to the terminal, the past game memory being accessible to at least one of the terminal and the win-checking system.

wherein the output means of the wager processing terminal is operable for indicating whether or not the winning combination was found on the ticket;

whereby screening of tickets is accomplished via the win-checking system and validation of winning tickets is accomplished using the wager processing terminal.

10. A computerized wagering system wherein player choices are matched with winning indicia, comprising:

at least one central computer operable to manage successive wagering games;

a plurality of distributed wager processing terminals in at least intermittent data communication with the central computer for operations including at least one of accepting and paying on wagers in the wagering games, each said terminal having input means and output means for managing a player entry via interactive display and input between the terminal and one or both of an agent and a player, the terminal and the central computer accepting wagering data defining choices of players of the wagering games managed by the central computer, said wagering data being reported to the central computer, acknowledged to the terminal by the central computer as referenced to the player entry, and evidenced by a ticket for the player entry, the ticket bearing the player choices and an identification of the game;

a win-checking system coupled to the computerized wagering system for operation by players apart from said operations of the wager processing terminals, the win-checking system comprising input means for entry of player choices and a corresponding identification of the game from an issued ticket;

a past game memory coupled to at least one of the central computer, one of the wager processing terminals and the win-checking system, for receiving and storing winning indicia chosen for the successive wagering games, the winning indicia being indexed to the identification of the game, wherein at least one of the win-checking system, the central computer and said one of the wager processing terminals is operable responsive to the win-checking system to make a comparison of the player choices from the issued ticket of a particular player entry, with contents of the past game memory applicable to a corresponding game, and to distinguish a winning combination therein;

output means coupled to win-checking system for indicating whether or not the winning combination is found on the issued ticket, responsive to a result of said comparison, whereby the winning combination is found and indicated apart from said operation of the wager processing terminal and without reference to the particular player entry in the wagering data; and, wherein the past game memory is sufficient to store the winning indicia and identifications of a limited number of the wagering games conducted successively, such that newer wagering game data is available in the memory and older wagering game data is unavailable, for comparison with the player choices from the ticket, and wherein the win-checking system is operable via the output means to indicate when the player choices and the identification applicable to the particular player entry are unavailable, whereupon said ticket can be checked by communications between the terminal and the central computer.

11. A win checking system for a wagering system wherein player choices are matched with winning indicia, the wagering system having a central computer to manage successive wagering games, and wager processing terminals in data communication with the central computer, the terminals each having input means and output means and communicating interactively with one of an agent and a player to accept wagering data defining choices of players of the wagering games, to report the wagering data to the central computer, to receive an acknowledgment from the central computer referenced to the player entry, to issue a ticket evidencing the player choices and an identification for at least one game to which the choices are applicable, and to store a record of player wagers for comparison with issued tickets for validating issued tickets later presented as winning tickets, the win checking system comprising:

input means for entry of player choices and a corresponding game identification from an issued ticket;

a past game memory, coupled to at least one of the central computer, one of the wager processing terminals and a processor of said win-checking system, the past game memory receiving and storing data representing winning indicia and the corresponding game identification of a plurality of the successive games;

wherein at least one of the central computer, the wager processing terminals and the processor of the win-checking system is operable to make a comparison of the identification and the player choices from the issued ticket with the winning indicia and the identifications of the successive games stored in the past game memory, and to distinguish a winning combination therein:

12. The win-checking system according to claim 11, wherein the input means coupled to the processor of the win-checking system comprises an automatic ticket reader with at least one of an optical character reader, a bar code scanner, a magnetic strip reader, and a data communications receiver.

13. The win-checking system according to claim 11, wherein the successive wagering games involve matching a first number of player choices to a larger number of potential winning choices, a winning entry being determined by at least one of correspondence, and extent of the correspondence, between the player choices and winning choices that are chosen from the potential winning choices for each of the wagering games, and wherein the comparison determines whether the player choices from the ticket exceed a minimum correspondence meriting a payout.

14. The win-checking system according to claim 13, wherein the wagering games include Keno and the comparison further determines that the player choices from the ticket fail to exceed a second, lower minimum correspondence meriting a payout.

15. The win-checking system according to claim 14, wherein the wagering games are conducted periodically a plurality of times per day, and wherein the memory of the past game memory includes capacity to store at least a most recent hour of winning combinations and identifications.

wherein at least one of the central computer, the wager processing terminals and the processor of the win-checking system is operable to make a comparison of the identification and the player choices from the issued ticket with the winning indicia and the identifications of the successive games stored in the past game memory, and to distinguish an unvalidated winning combination therein without reference to the record of player wagers; and, output means triggerable as a function of said comparison for indicating whether or not the winning combination is found on the issued ticket, whereby the winning combination is found and indicated apart from said operation of the terminal.

16. A win checking system for a wagering system wherein player choices are matched with winning indicia, the wagering system having a central computer to manage successive wagering games, and wager processing terminals in data communication with the central computer, the terminals each having input means and output means and conducting operations interactively with one of an agent and a player to accept wagering data defining choices of players of the wagering games, to report the wagering data to the central computer, to receive an acknowledgment from the central computer referenced to the player entry, and to issue a ticket evidencing the player choices and an identification for at least one game to which the choices are applicable, comprising:

input means for entry of player choices and a corresponding game identification from an issued ticket;

a past game memory, coupled to at least one of the central computer, one of the wager processing terminals and a processor of said win-checking system, the past game memory being operable to receive and store data representing winning indicia and the corresponding game identification of a plurality of the successive games;

wherein at least one of the central computer, the wager processing terminals and the processor of the win-checking system is operable to make a comparison of the identification and the player choices from the issued ticket with the winning indicia and the identifications of the successive games stored in the past game memory, and to distinguish a winning combination therein;

output means triggerable as a function of said comparison for indicating whether or not the winning combination is found on the issued ticket, whereby the winning combination is found and indicated apart from said operation of the terminal; and, wherein the past game memory is sufficient to store the winning indicia and identifications of a limited number of the wagering games conducted successively, such that newer wagering game data is available in the past game memory and older wagering game data is unavailable, for comparison with the player choices from the ticket, and wherein the output means is arranged to indicate when the player choices and the identification applicable to a particular ticket are unavailable, whereupon said particular ticket can be checked by communications between the terminal and the central computer.

17. A method of checking wins in a wagering system wherein player choices evidenced by issued tickets are to be matched against winning indicia, the wagering system having a central data store of wagering data identifying particular wager transactions, for comparison with data on previously accepted wagers evidenced by the issued tickets when the issued tickets are presented for validation as winning tickets, and wager processing terminals coupled to the central data store via a communication network, the terminals having input means and output means operable interactively with one of an agent and a player for accepting wagers and recording the player choices for the particular wager transactions, the terminals and the data store being coupled over a data network, the method of checking wins comprising the steps of:

maintaining a past game memory in addition to the wagering data on particular wager transactions, the past game memory being coupled to the communication network and storing corresponding winning choices indexed to game identifications in the wagering games for at least a predetermined time after the wagering games occur, whereby the winning choices for particular games can be checked without attempting to validate the issued tickets as winning tickets by accessing the wagering data identifying the particular wager transactions;

providing a ticket reader on the network, and reading the player choices and the game identification applicable thereto from tickets issued to players and presented as potential winning tickets;

determining the winning choices for said game identification in the past game memory, and comparing the player choices from the potential winning tickets to the winning choices in the past game memory;

distinguishing unvalidated winning tickets among the potential winning tickets, without reference to the wagering data on the particular wager transactions, the winning tickets meeting a minimum criteria of comparison between the player choices read from the ticket and the winning choices in corresponding said wagering games.

18. The method of checking wins according to claim 17, further comprising validating a ticket distinguished as a winning ticket, after said distinguishing step, by reference to the wagering data on the particular wager transactions for verifying that the winning tickets distinguished from the potential winning tickets with reference to the wagering data on the particular wager transactions.

19. The method of checking wins according to claim 17, wherein the ticket reader is provided as a peripheral to one of the terminals, and further comprising reporting over the network one of the winning choices with corresponding game identifications of said wagering games, and the player choices with game identifications from the issued tickets, said reporting over the network being accomplished for at least one of downloading the winning choices and the corresponding game identifications to said past game memory and uploading the player choices and game identifications from the tickets, for comparison with the past game memory.

20. The method of checking wins according to claim 19, wherein the past game memory is located on a same premises as the terminal and the winning choices and corresponding game identifications are downloaded to the past game memory over the network.

* * * * *

UNITED STATES PATENT AND TRADEMARK OFFICE

CERTIFICATE OF CORRECTION

PATENT NO. : 5,417,424

DATED : May 23, 1995

INVENTOR(S) : Guy B. Snowden and Victor Markowicz

It is certified that error appears in the above-indentified patent and that said Letters Patent is hereby corrected as shown below:

Column 7, line 58, delete "present rag" and insert therefor –presenting–.

Column 12, line 47, delete "flay" and insert therefor –day–.

Column 14, Claim 1, line 38, delete "wiring" and insert therefor –winning–.

Column 14, Claim 1, line 53, delete "reposed" and insert therefor –reported–.

Column 17, Claim 11, line 64, delete "a" and insert therefor –an unvalidated–.

Column 18, Claim 15, delete from "wherein" in line 25 through "terminal." in line 39.

Signed and Sealed this

Twelfth Day of March, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,417,424
DATED : May 23, 1995
INVENTOR(S) : Snowden et al.

It is certified that error appears in the above-indentified patent and that said Letters Patent is hereby corrected as shown below:

Column 17, line 64 "a" should read —an unvalidated

Column 17, Claim 11, line 64, delete":" and insert therefor

--without reference to the record of player wagers; and, output means triggerable as a function of said comparison for indicating whether or not the winning combination is found on the issued ticket, whereby the winning combination is found and indicated apart from said operation of the terminal.--

Signed and Sealed this
Second Day of July, 1996

Bruce Lehman

*Attest:*

BRUCE LEHMAN

*Attesting Officer*

*Commissioner of Patents and Trademarks*